US008036579B2

(12) United States Patent
Nishiyama et al.

(10) Patent No.: US 8,036,579 B2
(45) Date of Patent: Oct. 11, 2011

(54) DEVELOPING DEVICE AND DEVELOPER CARTRIDGE

(75) Inventors: Hideshi Nishiyama, Nagoya (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 542 days.

(21) Appl. No.: 12/057,596

(22) Filed: Mar. 28, 2008

(65) Prior Publication Data

US 2008/0240790 A1 Oct. 2, 2008

(30) Foreign Application Priority Data

Mar. 28, 2007 (JP) ..... 2007-085286

(51) Int. Cl.
*G03G 15/08* (2006.01)

(52) U.S. Cl. ..... 399/263; 399/120; 399/256

(58) Field of Classification Search ..... 399/119, 399/120, 252, 254, 256, 258–260, 262, 263; 222/DIG. 1
See application file for complete search history.

(56) References Cited

U.S. PATENT DOCUMENTS

| | | | | |
|---|---|---|---|---|
| 5,659,859 | A * | 8/1997 | Kikuta et al. | 399/256 |
| 5,842,090 | A * | 11/1998 | Mikawa | 399/256 |
| 5,995,789 | A * | 11/1999 | Murakami et al. | 399/262 |
| 2006/0008297 | A1 * | 1/2006 | Oyama et al. | 399/254 |

FOREIGN PATENT DOCUMENTS

| | | |
|---|---|---|
| JP | 08-050405 | 2/1996 |
| JP | 09-319202 | 12/1997 |

* cited by examiner

*Primary Examiner* — David Porta
*Assistant Examiner* — Benjamin Schmitt
(74) *Attorney, Agent, or Firm* — Banner & Witcoff, Ltd.

(57) ABSTRACT

A developing device and a developer cartridge are provided. The developing device includes a first housing that receives a developing roller; a second housing that is disposed adjacent to and detachable from the first housing and stores developer; first and second communication paths that allow an inside of the first housing to communicate with an inside of the second housing and an agitator that is provided within the second housing and conveys the developer from the first communication path toward the second communication path. The developing cartridge includes a housing that stores developer and an agitator including a rotational shaft that is disposed in one direction and a first blade that is provided at a midpoint in the axial direction of the rotational shaft and conveys the developer from the midpoint in the axial direction of the rotational shaft to both end portions of the rotational shaft.

19 Claims, 6 Drawing Sheets

DEVELOPING DEVICE AND DEVELOPER CARTRIDGE

CROSS-REFERENCE TO RELATED APPLICATIONS

This application claims priority from Japanese Patent Application No. 2007-085286 filed on Mar. 28, 2007, the entire subject matter of which is incorporated herein by reference.

TECHNICAL FIELD

Aspects of the present invention relate to a developing device and a developer cartridge installed in an image forming apparatus.

BACKGROUND

There has been proposed a developing device, which is detachably installed in an image forming apparatus such as a laser printer.

For example, JP-A-9-319202 describes a related art developing device including a unit frame having a partitioned developing chamber for receiving an auger roller, a supply roller, and a developing roller, and a toner cartridge detachably attached to the unit frame.

In the related art developing device, a toner supply port is formed at a central position (the central position in the axial direction of the developing roller) of the unit frame and the toner cartridge, and toner suction ports are formed at both sides of the toner supply port.

Toner stored in the toner cartridge is supplied from the toner supply port to an inside of the developing chamber. Thereafter, the toner is supplied to a supply roller, and then from the supply roller to the developing roller, and is carried on the developing roller. In contrast, the toner which has not been supplied to the supply roller is conveyed by the auger roller from the central position toward both end portions, and thereafter, the toner returns to the inside of the toner cartridge from the toner suction ports. Accordingly, the toner circulates and the flowability of the toner is secured.

However, when the toner supply port at the central position supplies toner from the toner cartridge to the inside of the developing chamber, and the toner suction ports at both sides return the toner from the developing chamber to the inside of the toner cartridge, in some cases the toner conveyed by the auger roller from the central position toward both end portions is not returned to the inside of the toner cartridge from the toner suction ports but is left accumulated at both sides within the developing chamber. In these cases, the toner accumulation may cause toner having different degrees of deterioration to become mixed within the developing chamber or the toner cartridge, thus deteriorating image quality.

SUMMARY

Aspects of the present invention provide a developing device capable of increasing circulation of developer and maintaining good image quality, and a developer cartridge installed in the developing device.

DETAILED DESCRIPTION

<General Overview>

According to an aspect of the present invention, there is provided a developing device including: a first housing that receives a developing roller; a second housing that is attachable to and detachable from the first housing and stores developer; a first communication path that is provided opposite the developing roller at a midpoint between both end portions in an axial direction of the developing roller and that allows an inside of the first housing to communicate with an inside of the second housing; a second communication path that is provided opposite the developing roller at both end portions in the axial direction of the developing roller and that allows the inside of the first housing to communicate with the inside of the second housing; and an agitator that is provided within the second housing and conveys the developer from the first communication path toward the second communication path.

According to another aspect of the present invention, there is provided a developer cartridge including: a housing that stores developer; and an agitator that is provided within the housing and agitates the developer, the agitator including: a rotational shaft that is disposed in one direction; and a first blade that is provided at a midpoint between end portions in the axial direction of the rotational shaft and conveys the developer from the midpoint in the axial direction of the rotational shaft to both end portions of the rotational shaft.

<Illustrative Aspects>

Illustrative aspects of the present invention will be described with reference to the drawings.

(Image Forming Apparatus)

Figure 1:
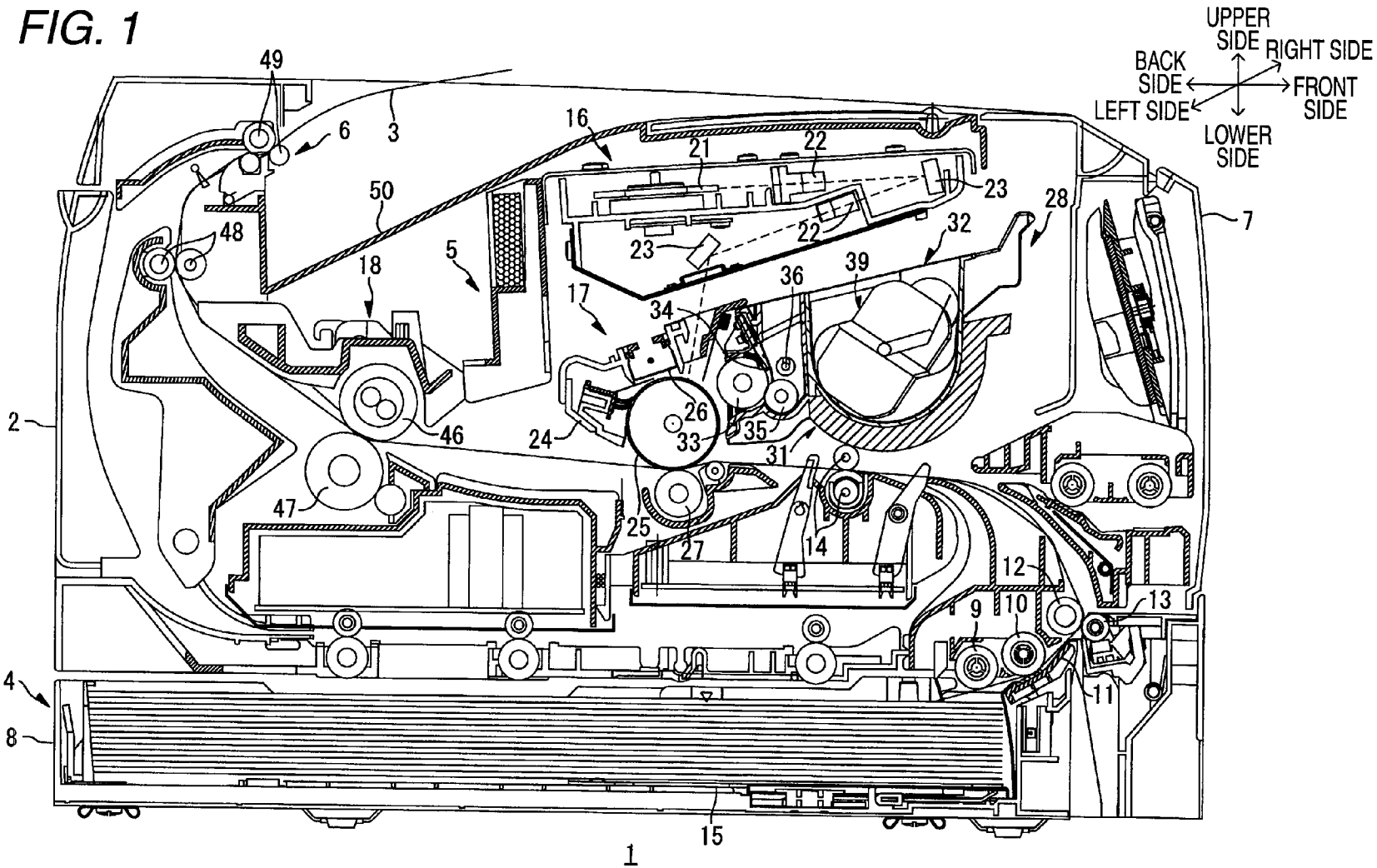
FIG. 1 is an exemplary side sectional view showing an image forming apparatus according to an illustrative aspect of the present invention.
Figure 2:
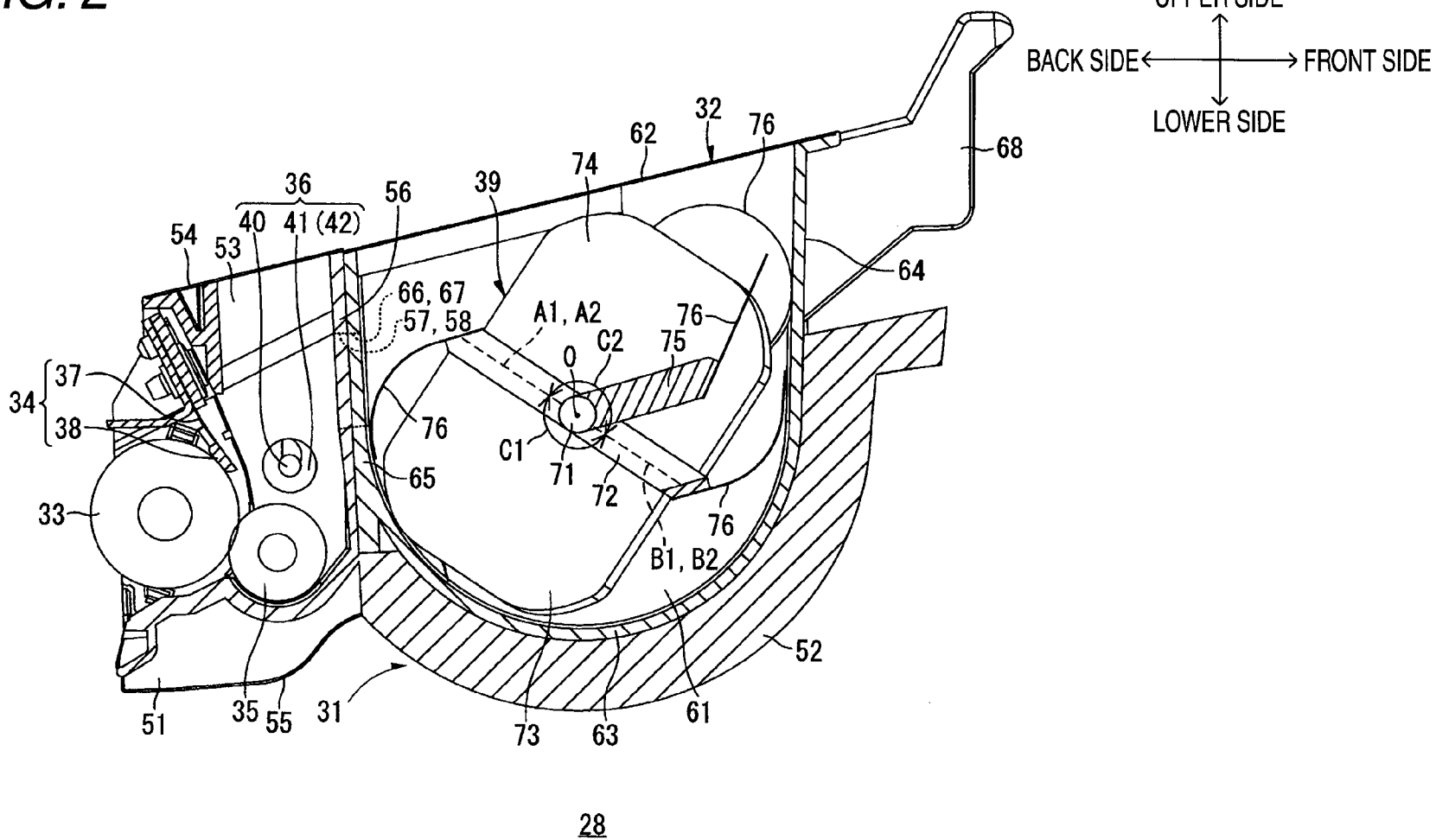
FIG. 2 is an exemplary side sectional view of a developing cartridge, according to an illustrative aspect of the present invention, of the image forming apparatus shown in FIG. 1.

FIG. 1 is an exemplary side sectional view showing an image forming apparatus according to an illustrative aspect of the present invention. FIG. 2 is an exemplary side sectional view of a developing cartridge, according to an illustrative aspect of the present invention, of the image forming apparatus shown in FIG. 1.

Figure 3:
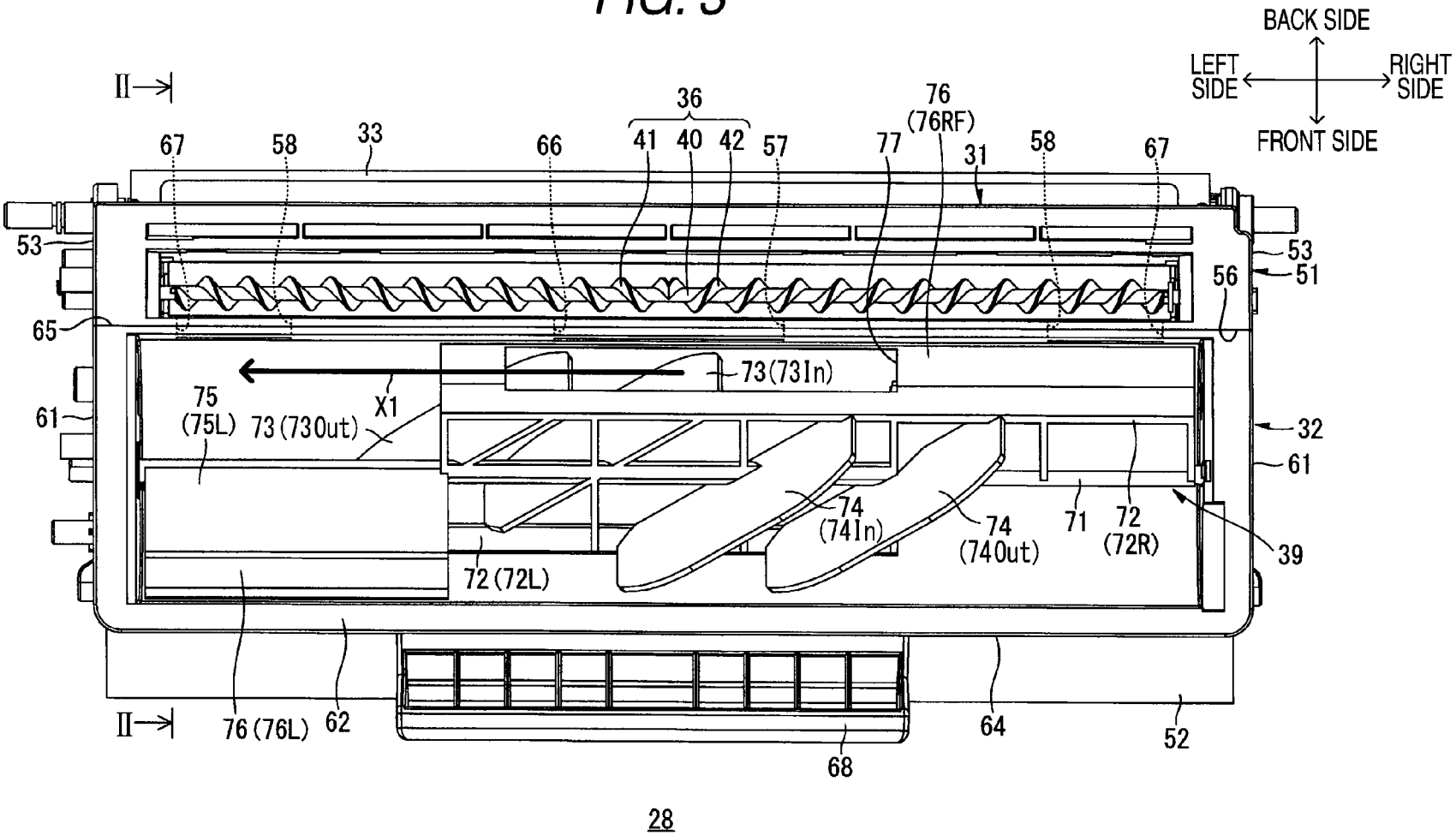
FIG. 3 is an exemplary top view of the developing cartridge of FIG. 2, showing an agitator in a leftward conveying state.

Incidentally, FIG. 2 is an exemplary sectional view taken along a line II-II in FIG. 3. In the drawings, shutters for opening or closing first and second communication ports of a housing portion 51 and a developer cartridge 32 are not shown.

As shown in FIG. 1, an image forming apparatus 1 includes, within a body casing 2, a sheet feeding portion 4 for feeding a sheet 3, an image forming portion 5 for forming an image on the fed sheet, and a sheet discharging portion 6 for discharging the image-formed sheet 3.

(1) Body Casing

The body casing 2 is formed in a box-like shape. An open opening is formed in a side wall at one side thereof, and a front cover 7 is provided for opening and closing the open opening. By opening the front cover 7, the body casing 2 can be attached or detached to or from a process cartridge 17 (described later).

In the following descriptions, the side at which the front cover 7 is provided will be referred to as a front side (front face side), and the opposite side will be referred to as a back side (rear side). In addition, the front side in the thickness direction of the sheet of FIG. 1 will be referred to as a left side, and the back side in the thickness direction of the sheet of FIG. 1 will be referred to as a right side. Incidentally, the left-right direction is the same as the width direction.

In the following, a process cartridge 17 (described later), a developing cartridge 28, and a developer cartridge 32 (described later) will be described based on their directions as they are attached to the body casing 2.

(2) Sheet Feeding Portion

The sheet feeding portion 4 includes a sheet feeding tray 8, a sheet feeding roller 9, a separation roller 10, a separation pad 11, sheet powder removing rollers 12 and 13, and a registration roller 14.

A sheet pressing plate 15 is provided within the sheet feeding tray 8. The sheet 3 on top of the sheet pressing plate 15 is fed by the sheet feeding roller 9 and is processed by the separation roller 10 and the separation pad 11 on a one-by-one basis. Thereafter, the separated sheet is passed through the sheet powder removing rollers 12 and 13 and is conveyed by the registration roller 14 to a transfer position (described later) of the image forming portion 5.

(3) Image Forming Portion

The image forming portion 5 includes a scanner unit 16, a process cartridge 17, and a fixing portion 18.

(3-1) Scanner Unit

The scanner unit 16 is provided in an upper portion within the body casing 2, and includes a laser emitting portion (not shown), a polygon mirror 21, a plurality of lenses 22, and a plurality of reflective mirrors 23.

As denoted by the chained line, laser beams emitted from the laser emitting portion based on image data are reflected from the polygon mirror 21 and then selectively passed through or reflected from the plurality of lenses 22 and the plurality of reflective mirrors 23, and are finally scanned onto the surface of a photosensitive drum 25 of the process cartridge 17.

(3-2) Process Cartridge

The process cartridge 17 is disposed under the scanner unit 16 within the body casing 2 and is detachably attached to the body casing 2.

The process cartridge 17 includes, within a process frame 24, the photosensitive drum 25, a scrotron-type charger 26, a transfer roller 27, and a developing cartridge 28 as an example of a developing device (a housing).

The photosensitive member 25 is supported by process frame 24 in a freely rotatable manner. The scrotron-type charger 26 is disposed at a distance above the photosensitive drum 25 and is supported by the process frame 24. The transfer roller 27 is disposed under the photosensitive drum 25 in an opposing relationship and is supported by the process frame 24 in a freely rotatable manner.

The developing cartridge 28 is detachably attached to the process frame 24. The developing cartridge 28 includes a developing frame 31 as an example of a first housing and a developer cartridge 32 as an example of a second housing that is detachably attached to the developing frame 31. Within the developing frame 31, a developing roller 33, a layer-thickness restricting blade 34, a supply roller 35, and an auger 36 are received.

The developing roller 33 is disposed on the front side of the photosensitive drum 25 in an opposing relationship and is supported by the developing frame 31 in a freely rotatable manner.

As shown in FIG. 2, the layer-thickness restricting blade 34 includes a plate spring member 37 formed in a thin plate shape and a pressure-contact rubber 38 provided at the lower end portion of the plate spring member 37. The upper end portion of the plate spring member 37 is fixed to the developing frame 31. The pressure-contact rubber 38 presses the surface of the developing roller 33 by the elastic force of the plate spring member 37.

The supply roller 35 is disposed on the front side of the developing roller 33 in an opposing relationship, and is supported by the developing frame 31 in a freely rotatable manner.

The auger 36 is disposed above the supply roller 35 and is supported by the developing frame 31 in a freely rotatable manner.

The developer cartridge 32 includes an agitator 39 and stores a developer. In the image forming apparatus 1 of the illustrative aspect, the developer comprises a suspension polymerization toner which is a nonmagnetic one-component toner with positive electrification.

The developer stored in the developer cartridge 32 is agitated by the rotation of the agitator 39 and is discharged to the inside of the developing frame 31 via a frame-side supply port 58 (described later) and a cartridge-side supply port 67 (described later) which are an example of a second communication path. Thereafter, the developer is supplied to the supply roller 35 while being conveyed with the rotation of the auger 36. In contrast, the developer which has not been supplied to the supply roller 35 is returned to the inside of the developer cartridge 32 via a frame-side return port 57 (described later) and a cartridge-side return port 66 (described later) which are an example of a first communication path.

The developer supplied to the supply roller 35 is supplied to the developing roller 33 by the rotation of the supply roller 35. The developer is positively charged by friction while being rubbed between the supply roller 35 and the developing roller 33. Subsequently, as the developing roller 33 rotates, the developer supplied to the developing roller 33 is moved between the pressure-contact rubber 38 and the developing roller 33, where the thickness of the developer layer is restricted, and a thin developer layer is then carried on the surface of the developing roller 33.

As shown in FIG. 1, as the photosensitive drum 25 rotates, the surface of the photosensitive drum 25 is first positively charged by the scorotron-type charger 26 in a uniform manner, and is then exposed by the laser beams from the scanner unit 16 so an electrostatic latent image based on image data is formed on the surface of the photosensitive drum 25. Next, when the developer carried on the surface of the developing roller 33 is brought into opposing contact with the photosensitive drum 25 by the rotation of the developing roller 33, the developer carried on the surface of the developing roller 33 is supplied to the electrostatic latent image formed on the surface of the photosensitive drum 25. Thus, the electrostatic latent image is developed (changed to a visible image), and a developer image is carried on the surface of the photosensitive drum 25. This developer image is transferred onto the sheet 3 conveyed to a position (a transfer position) between the photosensitive drum 25 and the transfer roller 27.

(3-3) Fixing Portion

The fixing portion 18 is provided on the back side of the process cartridge 17. The fixing portion 18 includes a heating roller 46 and a pressure roller 47 disposed under the heating roller 46 so as to make pressure contact with the heating roller 46.

In the fixing portion 18, the developer transferred onto the sheet 3 at the transfer position is thermally fixed during the passage of the sheet 3 between the heating roller 46 and the pressure roller 47.

(4) Sheet Discharging Portion

The sheet discharging portion 6 includes a conveying roller 48, a sheet discharge roller 49, and a sheet discharge tray 50. The sheet 3 having a developer thermally fixed thereto is conveyed by the conveying roller 48 to the sheet discharge roller 49 and is then discharged onto the sheet discharge tray 50 by the sheet discharge roller 49.

(Developing Cartridge)

Figure 4:
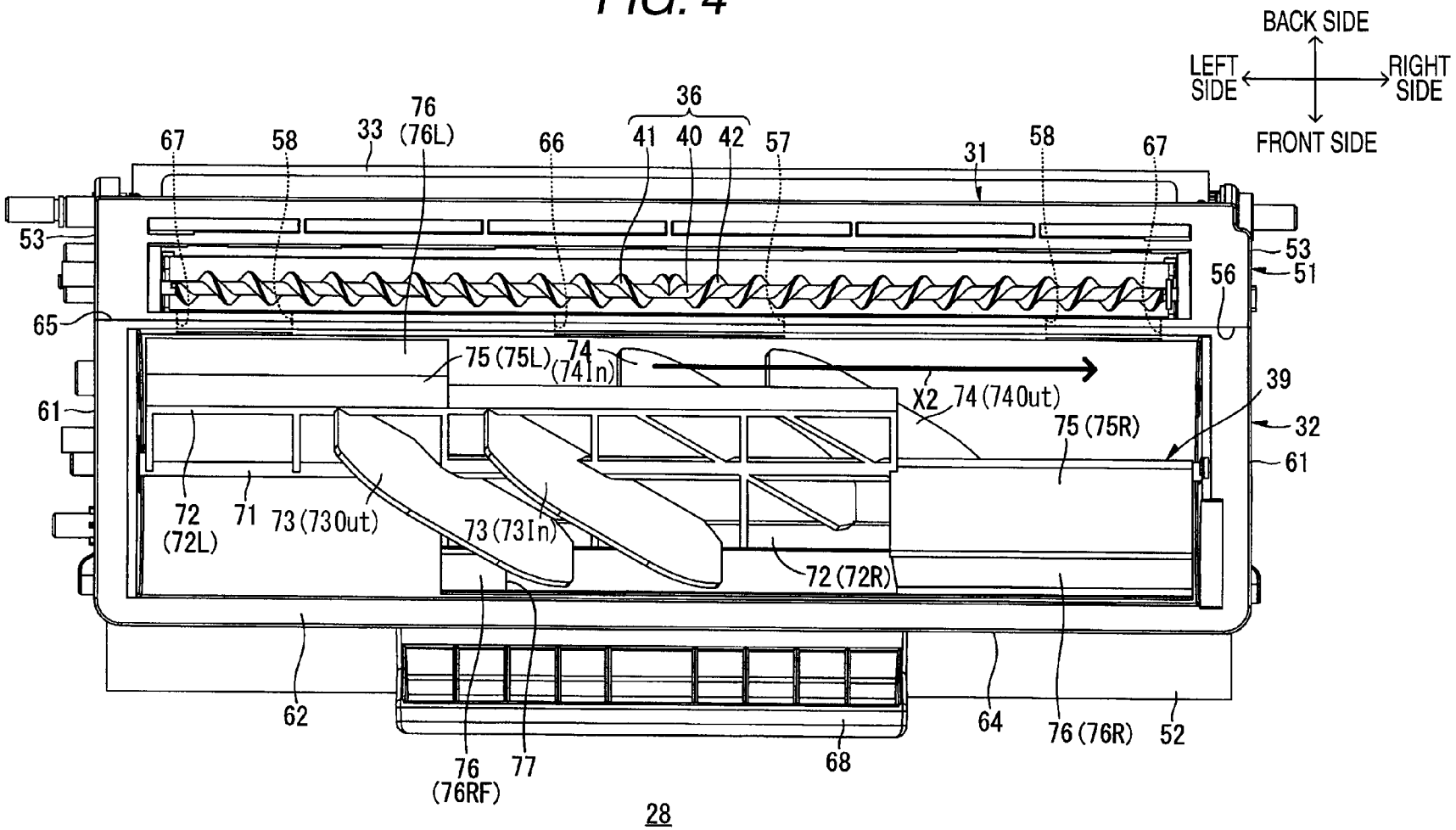
FIG. 4 is an exemplary top view of the developing cartridge of FIG. 2, showing an agitator in a rightward conveying state.
Figure 5:
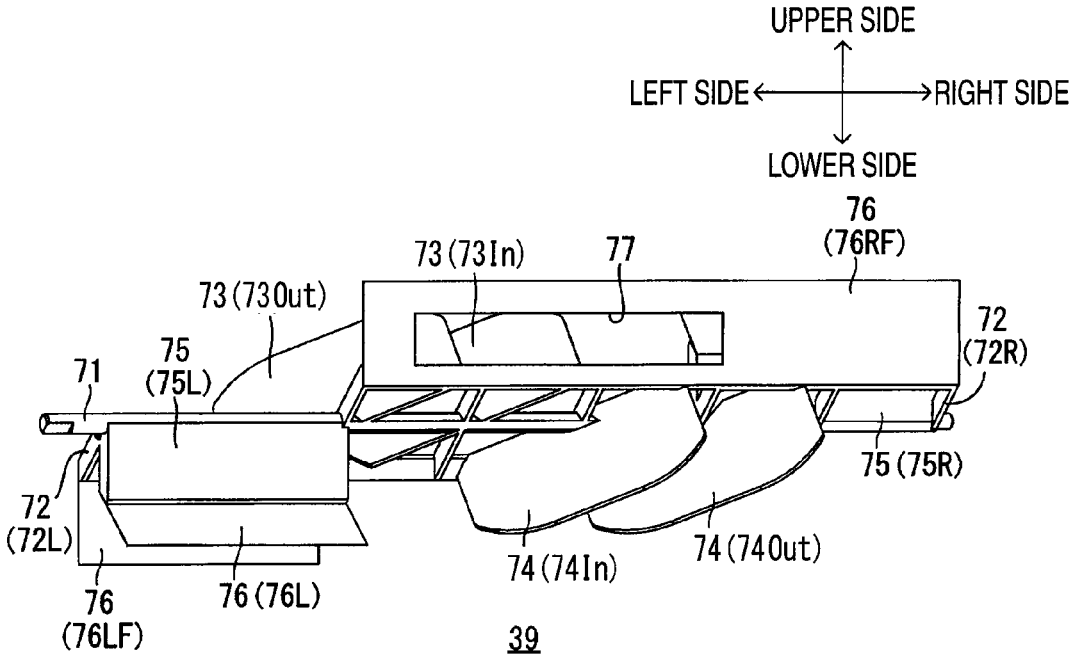
FIG. 5 is an exemplary perspective view of the agitator of the developing cartridge of FIG. 2 in the leftward conveying state.
Figure 6:
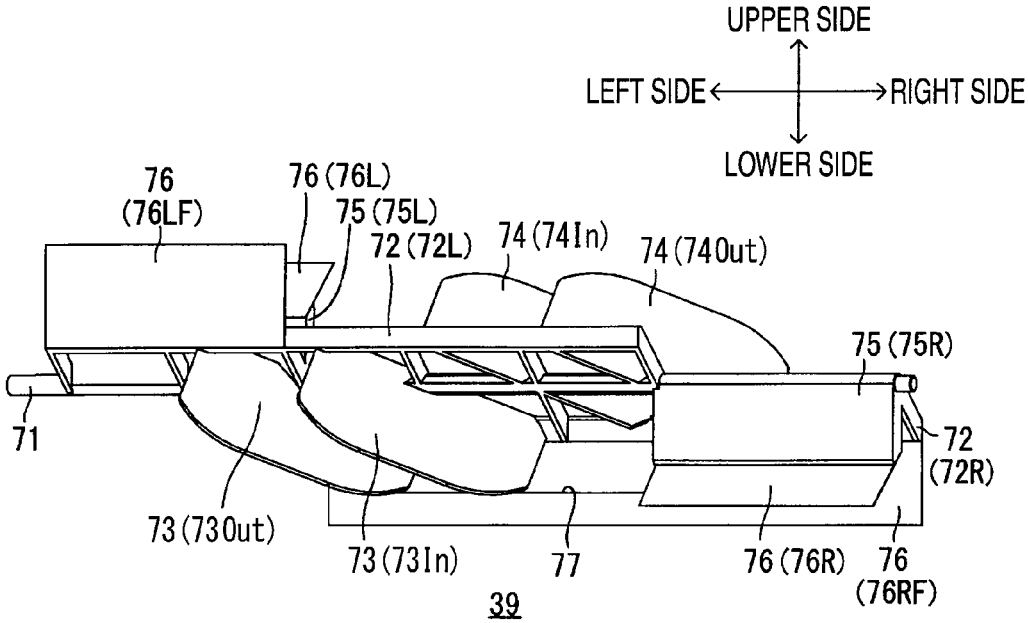
FIG. 6 is an exemplary perspective view of the agitator of the developing cartridge of FIG. 2 in the rightward conveying state.
Figure 7:
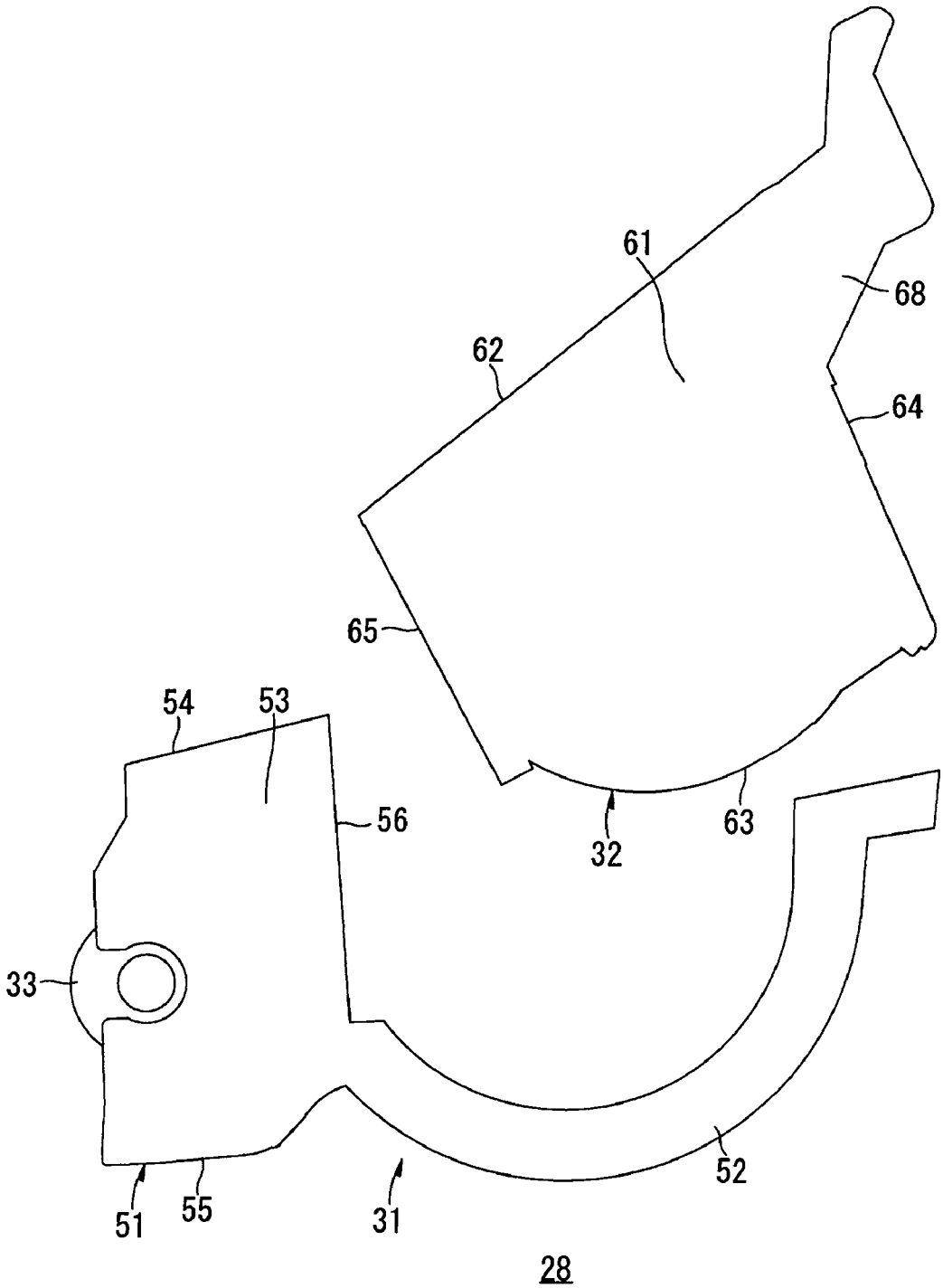
FIG. 7 is a schematic view showing attaching and detaching of the developer cartridge of the developing cartridge of FIG. 2 to and from a developing frame.

FIGS. 3 to 7 are views of a developing cartridge according to an illustrative aspect of the present invention. FIG. 3 is a top view of the developing cartridge, showing an agitator in the leftward conveying state; FIG. 4 is a top view of the developing cartridge, showing an agitator in the rightward conveying state; FIG. 5 is a perspective view of the agitator in the leftward conveying state; FIG. 6 is a perspective view of the agitator in the rightward conveying state; and FIG. 7 is a schematic view showing attaching and detaching of the developer cartridge to and from a developing frame. In FIGS. 3 and 4, top walls 54 and 62 are separated from each other.

(1) Developing Frame

As shown in FIGS. 2 and 3, the developing frame 31 integrally includes a housing portion 51 and a cartridge receiving portion 52 (best observed in FIG. 2).

(a) Housing Portion

As shown in FIGS. 2 and 3, the housing portion 51 is formed in a box-like shape that extends in the width direction with its back side open. The housing portion 51 integrally includes side walls 53 disposed in an opposing relationship to a gap defined in the width direction, a top wall 54 that covers an upper area between the side walls 53, a bottom wall 55 that covers a lower area between the side walls 53, and a front wall 56 that covers a front area between the side walls 53.

The frame-side return port 57 and the frame-side supply ports 58 are opened in the front wall 56. The frame-side return port 57 is formed at the central portion of the front wall 56 in the width direction. The frame-side return port 57 is formed substantially in a rectangular shape that is long in the width direction. The frame-side supply ports 58 are formed at both end portions of the front wall 56 in the width direction at a distance from both ends of the frame-side return port 57 in the width direction. The respective frame-side supply ports 58 are formed substantially in a rectangular shape that is long in the width direction.

Within the housing portion 51, the developing roller 33, the layer-thickness restricting blade 34, the supply roller 35, and the auger 36 are arranged toward the back of the housing portion 51 (see FIG. 2).

The developing roller 33 is disposed in the width direction and is supported by the side walls 53 in a freely rotatable manner. When seen in the front-back direction, the frame-side return port 57 is disposed at the central portion of the developing roller 33 in the width direction in an opposing relationship, and the frame-side supply ports 58 are disposed at both end portions of the developing roller 33 in the width direction in an opposing relationship.

In the layer-thickness restricting blade 34, the upper end portion of the plate spring member 37 is fixed to the top wall 54, and the pressure-contact rubber 38 at the lower end portion of the plate spring member 37 is disposed in pressure contact with an upper front portion of the developing roller 33.

The supply roller 35 is in contact with a lower front portion of the developing roller 33 and disposed in the width direction in an opposing relationship to the front wall 56, and is supported by the side walls 53 in a freely rotatable manner.

The auger 36 is disposed above the supply roller 35 in an opposing relationship to the front wall 56. The auger 36 includes an auger shaft 40 and a rightward conveying screw 41 and a leftward conveying screw 42 that are provided around the auger shaft 40. The auger shaft 40 is disposed in the width direction and is supported by the side walls 53 in a freely rotatable manner. The rightward conveying screw 41 extends from the central portion of the auger shaft 40 in the width direction to the left end portion of the auger shaft 40 in the width direction. The rightward conveying screw 41 is formed in a spiral shape so as to convey the developer rightward. The leftward conveying screw 42 extends from the central portion of the auger shaft 40 in the width direction to the right end portion of the auger shaft 40 in the width direction. The leftward conveying screw 42 is formed in a spiral shape that is opposite to the spiral shape of the rightward conveying screw 41 so as to convey the developer leftward.

(b) Cartridge Receiving Portion

As shown in FIG. 2, the cartridge receiving portion 52 is formed of a thick plate with a cross section having a circular arc shape (a downwardly convex circular arc shape) that extends from the lower end portion of the front wall 56 toward the front side.

(2) Developer Cartridge

The developer cartridge 32 is a housing for storing a developer, and is formed in a box-like shape that extends in the width direction, as shown in FIGS. 2 and 3. The developer cartridge 32 integrally includes side walls 61 disposed in an opposing relationship to a gap defined in the width direction, a top wall 62 that covers an upper area between the side walls 61, a bottom wall 63 that covers a lower area between the side walls 53 and has a cross section of a circular arc shape (a downwardly convex circular arc shape), a front wall 64 that covers a front area between the side walls 61, and a back wall 65 that covers a back area between the side walls 61.

The cartridge-side return port 66 and the cartridge-side supply ports 67 are opened in the back wall 65. The cartridge-side return port 66 is formed at the central portion of the back wall 65 in the width direction. The cartridge-side return port 66 is formed substantially in a rectangular shape that is long in the width direction, which is substantially the same shape as the frame-side return port 57. The cartridge-side supply ports 67 are formed at both end portions of the back wall 65 in the width direction at a distance from both ends of the cartridge-side return port 66 in the width direction. The respective cartridge-side supply ports 67 are formed substantially in a rectangular shape that is long in the width direction, which is substantially the same shape as the frame-side supply ports 58.

A grasping portion 68 is provided at the upper end portion of the front wall 64 so as to protrude toward the front side.

As shown in FIG. 7, the developer cartridge 32 is detachably attached to the cartridge receiving portion 52. When the developer cartridge 32 is attached to the cartridge receiving portion 52, as shown in FIG. 2, the bottom wall 63 is received in the cartridge receiving portion 52, and the developer cartridge 32 is disposed on the front side of the housing portion 51 in an adjacent relationship. Generally, in the state in which the developer cartridge 32 is detached from the cartridge receiving portion 52, shutters are provided on the developer cartridge 32 and the housing portion 51 so as to open or close the cartridge-side return port 66, the cartridge-side supply ports 67, the frame-side return port 57, and the frame-side supply ports 58. In this illustrative aspect, the shutters are not shown in order to more clearly show the elements described above.

When the developer cartridge 32 is attached to the cartridge receiving portion 52 as shown in FIG. 2, the cartridge-side return port 66 is disposed in an opposing relationship to the frame-side return port 57 in the front-back direction. Accordingly, the inside of the housing portion 51 and the inside of the developer cartridge 32 can communicate with each other via the frame-side return port 57 and the cartridge-side return port 66 at the central portion in the width direction.

When the developer cartridge 32 is attached to the cartridge receiving portion 52, the cartridge-side supply ports 67 are disposed in an opposing relationship to the frame-side supply ports 58 in the front-back direction. Accordingly, the inside of the housing portion 51 and the inside of the developer cartridge 32 can communicate with each other via the frame-side supply ports 58 and the cartridge-side supply ports 67 at both end portions in the width direction.

When the grasping portion 68 is grasped to lift up the developer cartridge 32 as shown in FIG. 7, the developer cartridge 32 is detached from the cartridge receiving portion 52.

(3) Agitator

As shown in FIGS. 5 and 6, the agitator 39 includes a rotational shaft 71, a lattice frame 72, an axially leftward conveying blade 73 as an example of a one-side blade of a first blade, and an axially rightward conveying blade 74 as an example of a the-other-side blade.

(a) Rotational Shaft

The rotational shaft 71 is formed in a round bar shape, and as shown in FIG. 2, is disposed at the central portion of the developer cartridge 32 when seen from a side view. As shown in FIG. 3, the rotational shaft 71 is disposed in the width direction and is supported by the side walls 61 in a freely rotatable manner.

(b) Lattice Frame

As shown in FIGS. 5 and 6, the lattice frame 72 is provided so as to extend outward from the rotational shaft 71 in the radial direction.

The lattice frame 72 at one side in the radial direction (this lattice frame is hereinafter referred to as a left-side lattice frame 72L) is formed in a trapezoidal shape that extends in the width direction, as shown in FIG. 6. The left-side lattice frame 72L protrudes from the rotational shaft 71 toward the one side in the radial direction and is provided on the rotational shaft 71 in the axial direction between the left end portion of the rotational shaft 71 and a portion displaced rightward in the axial direction by about ⅔ of the rotational shaft 71.

The lattice frame 72 at the other side in the radial direction (this lattice frame hereinafter referred to as a right-side lattice frame 72R) is formed in a trapezoidal shape that extends in the width direction, as shown in FIG. 5. The right-side lattice frame 72R protrudes from the rotational shaft 71 toward the other side in the radial direction and is provided on the rotational shaft 71 in the axial direction between the right end portion of the rotational shaft 71 and a portion displaced leftward in the axial direction by about ⅔ of the rotational shaft 71. The right-side lattice frame 72R and the left-side lattice frame 72L are displaced 180 degrees from each other around the rotational shaft 71.

(c) Axial Conveying Blades

As shown in FIG. 5, two first axial conveying blades 73 are provided in the vicinity of the central portion of the rotational shaft 71 in the axial direction and on the surface on one side of the lattice frame 72 (i.e., the lattice frame 72 including both the right-side lattice frame 72R and the left-side lattice frame 72L) with a gap defined in the width direction. In other words, in FIG. 5, the two first axial conveying blades 73 are provided on the upper side of the lattice frame 72. (Note that in FIG. 6, the rotational shaft 71 has been rotated 180 degrees so that the first axial conveying blades 73 are facing the bottom in FIG. 6.) The first axial conveying blades 73 are formed substantially in a rectangular plate shape and are arranged in a direction intersecting the axial direction of the rotational shaft 71. The first axial conveying blades 73 stand perpendicular to the one-side surface of the lattice frame 72 on the one-side surface of the lattice frame 72. Accordingly, as shown in FIG. 2, the first axial conveying blades 73 are arranged around the rotational shaft 71 with the central angle C1 within a range of about 180 degrees. That is, the first axial conveying blades 73 are provided within the range of an arc A1B1 having a central angle C1 of about 180 degrees with respect to the rotation center O of the rotational shaft 71, in which the arc A1B1 has one edge A1 on a fringe portion (denoted by a dotted line) on one side of the rotational shaft 71 and the other edge B1 on a fringe portion (denoted by a dotted line) on the other side of the rotational shaft 71.

As shown in FIG. 5, the first axial conveying blade 73 on one side (the inner side in the width direction) (this first axial conveying blade is hereinafter referred to as an inner first axial conveying blade 73In) is provided on a region where both the left-side lattice frame 72L and the right-side lattice frame 72R are provided (this region is hereinafter referred to as a central region of the lattice frame 72). The inner first axial conveying blade 73In obliquely crosses the rotational shaft 71 so the one end portion thereof is disposed slightly to a right side of the central portion of the rotational shaft 71 in the axial direction, and the other end portion thereof is disposed slightly to a left side of the central portion of the rotational shaft 71 in the axial direction.

In contrast, the first axial conveying blade 73 on the other side (the outer side in the width direction) (this first axial conveying blade is hereinafter referred to as an outer first axial conveying blade 73Out) is disposed on the left side of the inner first axial conveying blade 73In. The outer first axial conveying blade 73Out is provided on the rotational shaft 71 so as to extend across the central region of the lattice frame 72 and a region where only the left-side lattice frame 72L is provided (the region where only the left-side lattice frame 72L is provided is hereinafter referred to as a left-side region of the lattice frame 72). The outer first axial conveying blade 73Out obliquely crosses the rotational shaft 71 so the one end portion thereof is disposed in the central region of the lattice frame 72 slightly at the left side of the central portion of the rotational shaft 71 in the axial direction, and the other end portion thereof is disposed in the left-side region of the lattice frame 72 in the axial direction.

The inner first axial conveying blade 73In and the outer first axial conveying blade 73Out are disposed in parallel to each other at the same intersection angle with respect to the rotational shaft 71, the angle selected from the range of greater than 0 degrees and smaller than 90 degrees. In this illustrative aspect, the inner first axial conveying blade 73In and the outer first axial conveying blade 73Out are disposed at an intersection angle of about 45 degrees with respect to the rotational shaft 71.

Meanwhile, two second axial conveying blades 74 are provided in the vicinity of the central portion of the rotational shaft 71 in the axial direction and on the surface on the other side of the lattice frame 72 with a gap defined in the width direction. The second axial conveying blades 74 are formed substantially in a rectangular plate shape, which is substantially the same shape as the first axial conveying blades 73, and are arranged in a direction intersecting the axial direction of the rotational shaft 71. The second axial conveying blades 74 stand perpendicular to the other-side surface of the lattice frame 72 on the other-side surface of the lattice frame 72. Accordingly, as shown in FIG. 2, the second axial conveying blades 74 are arranged around the rotational shaft 71 with the central angle C2 within a range of about 180 degrees. That is, the second axial conveying blades 74 are provided within the range of an arc A2B2 having a central angle C2 of about 180 degrees with respect to the rotation center O of the rotational shaft 71, in which the arc A2B2 has one edge A2 on a fringe portion (denoted by a dotted line) on one side of the rotational shaft 71 and the other edge B2 on a fringe portion (denoted by a dotted line) on the other side of the rotational shaft 71.

As shown in FIG. 5, the second axial conveying blade 74 on one side (the inner side in the width direction) (this second axial conveying blade is hereinafter referred to as an inner second axial conveying blade 74In) is provided on the central region of the lattice frame 72. The inner second axial conveying blade 74In obliquely crosses the rotational shaft 71 so the one end portion thereof is disposed slightly at the left side of the central portion of the rotational shaft 71 in the axial direction, and the other end portion thereof is disposed slightly at the right side of the central portion of the rotational shaft 71 in the axial direction.

In contrast, the second axial conveying blade 74 on the other side (the outer side in the width direction) (this second axial conveying blade is hereinafter referred to as an outer second axial conveying blade 74Out) is disposed to the right side of the inner second axial conveying blade 74In. The outer second axial conveying blade 74Out is provided on the rotational shaft 71 so as to extend across the central region of the lattice frame 72 and a region where only the right-side lattice frame 72R is provided (the region where only the right-side lattice frame 72R is provided is hereinafter referred to as a right-side region of the lattice frame 72). The outer second axial conveying blade 74Out obliquely crosses the rotational shaft 71 so the one end portion thereof is disposed in the central region of the lattice frame 72 slightly at the right side of the central portion of the rotational shaft 71 in the axial direction, and the other end portion thereof is disposed in the right-side region of the lattice frame 72 in the axial direction.

The inner second axial conveying blade 74In and the outer second axial conveying blade 74Out are disposed in parallel to each other at the same intersection angle with respect to the rotational shaft 71, the angle selected from the range of greater than 0 degrees and smaller than 90 degrees, in a manner similar to the case of the inner first axial conveying blade 73In and the outer first axial conveying blade 73Out. In this illustrative aspect, the inner second axial conveying blade 74In and the outer second axial conveying blade 74Out are disposed at an intersection angle of about 45 degrees with respect to the rotational shaft 71.

Accordingly, the first axial conveying blades 73 and the second axial conveying blades 74 are provided at both sides of a straight line in a projection plane of the blades projected in the axial direction of the rotational shaft 71, the straight line passing the rotational shaft 71 in a radial direction along the lattice frame 72. That is, the respective blades 73 and 74 are provided on the one-side surface and the the-other-side surface of the lattice frame 72, respectively.

The first axial conveying blades 73 and the second axial conveying blades 74 are disposed in the vicinity of the central portion of the rotational shaft 71 in the axial direction at the left and right sides of the rotational shaft 71 in the axial direction. The respective blades 73 and 74 are provided at the same intersection angle with respect to the rotational shaft 71 so as not to overlap with each other in the axial direction and are disposed in parallel to each other with a gap defined in the width direction.

As shown in FIG. 3, the first axial conveying blades 73 and the second axial conveying blades 74 are disposed in an opposing relationship to the cartridge-side return port 66 in the front-back direction. That is, the first axial conveying blades 73 and the second axial conveying blades 74 are disposed coincidentally within a projection range of the cartridge-side return port 66 projected in the front-back direction.

More specifically, the inner second axial conveying blade 73In is disposed in a partially overlapping manner with the cartridge-side return port 66 in the front-back direction so the right end portion is disposed slightly to the right side of a center of the cartridge-side return port 66 in the width direction, and the left end portion is disposed to the left side of the left end portion of the cartridge-side return port 66.

Meanwhile, the inner second axial conveying blade 74In is disposed in a partially overlapping manner with the cartridge-side return port 66 in the front-back direction so the left end portion is disposed slightly to the left side of the center of the cartridge-side return port 66 in the width direction, and the right end portion is disposed to the right side of the right end portion of the cartridge-side return port 66.

The outer first axial conveying blade 73Out is disposed such that the right end portion overlaps with the left end portion of the cartridge-side return port 66 in the front-back direction. The outer second axial conveying blade 74Out is disposed such that the left end portion overlaps with the right end portion of the cartridge-side return port 66 in the front-back direction.

The right end portion of the outer first axial conveying blade 73Out is disposed at the right side of the left end portion of the inner first axial conveying blade 73In. The left end portion of the outer second axial conveying blade 74Out is disposed at the left side of the right end portion of the inner second axial conveying blade 74In.

(d) Radial Conveying Blade

As shown in FIGS. 5 and 6, the agitator 39 includes a radial conveying blade 75 as an example of a second blade. The radial conveying blade 75 is provided at both end portions of the rotational shaft 71 in the axial direction. The respective radial conveying blades 75 are formed substantially in a rectangular plate shape that extends in the width direction.

The radial conveying blade 75 on the left side (this radial conveying blade is hereinafter referred to as a left-side radial conveying blade 75L) is provided adjacent to the right-side lattice frame 72R in the axial direction of the rotational shaft 71. That is, the left-side radial conveying blade 75L is provided in parallel to the rotational shaft 71 between the left end portion of the rotational shaft 71 and a portion displaced rightward in the width direction by about ⅓ of the rotational shaft 71. As shown in FIG. 2, the left-side radial conveying blade 75L protrudes from the rotational shaft 71 in the radial direction so that the left-side radial conveying blade 75L and the left-side lattice frame 72L that protrudes in the same direction are provided within the range of an angle C3 selected from the range of greater than about 0 degrees and smaller than about 90 degrees with respect to each other. In this illustrative aspect, the left-side radial conveying blade 75L and the left-side lattice frame 72L are provided at an angle C3 of about 45 degrees with respect to each other.

The radial conveying blade 75 on the right side (this radial conveying blade is hereinafter referred to as a right-side radial conveying blade 75R) is provided adjacent to the left-side lattice frame 72L in the axial direction of the rotational shaft 71, as shown in FIG. 6. That is, the right-side radial conveying blade 75R is provided in parallel to the rotational shaft 71 between the right end portion of the rotational shaft 71 and a portion displaced leftward in the width direction by about ⅓ of the rotational shaft 71. The right-side radial conveying blade 75R protrudes from the rotational shaft 71 in the radial direction so that the right-side radial conveying blade 75R and the right-side lattice frame 72R that protrudes in the same direction are provided within the range of an angle C3 selected from the range of greater than about 0 degrees and smaller than about 90 degrees with respect to each other. In this illustrative aspect, the right-side radial conveying blade 75R and the right-side lattice frame 72R are provided at an angle C3 of about 45 degrees with respect to each other.

The angle formed between the left-side radial conveying blade 75L and the left-side lattice frame 72L is set so as to be the same as the angle formed between the right-side radial conveying blade 75R and the right-side lattice frame 72R.

Accordingly, the left-side radial conveying blade 75L and the right-side radial conveying blade 75R are displaced 180 degrees from each other around the rotational shaft 71. That is, the left-side radial conveying blade 75L and the right-side radial conveying blade 75R are provided so as to extend outward from the rotational shaft 71 in the radial direction. Moreover, the left-side radial conveying blade 75L and the right-side radial conveying blade 75R are provided at both sides of a line perpendicular to a straight line in a projection plane of the blades projected in the axial direction of the rotational shaft 71, the straight line passing the rotational shaft 71 in the radial direction along the radial conveying blade 75.

The left-side radial conveying blade 75L, the right-side radial conveying blade 75R, and the lattice frame 72 are disposed at respective angles with respect to the rotation center of the rotational shaft 71 and are provided at different positions in the circumferential direction (the rotational direction) of the rotational shaft 71.

As shown in FIG. 3, the left-side radial conveying blade 75L and the right-side radial conveying blade 75R are disposed in an opposing relationship to the cartridge-side supply port 67 on the left side in the front-back direction (this cartridge-side supply port hereinafter referred to as a left-side cartridge-side supply port 67L) and to the cartridge-side supply port 67 on the right side in the front-back direction (this cartridge-side supply port hereinafter referred to as a right-side cartridge-side supply port 67R), respectively.

(e) Bottom Sweeping Blade

As shown in FIGS. 5 and 6, the agitator 39 includes a bottom sweeping blade 76 as an example of a third blade. The bottom sweeping blade 76 is formed of a flexible film, and is provided at the radially outer end portions of the left-side lattice frame 72L, the right-side lattice frame 72R, the left-side radial conveying blade 75L, and the right-side radial conveying blade 75R.

The bottom sweeping blade 76 provided at the radially outer end portion of the left-side lattice frame 72L (this bottom sweeping blade is hereinafter referred to as a left-frame bottom sweeping blade 76LF) is formed substantially in a rectangular shape that extends in the width direction, and is provided at the radially outer end portion (i.e., the left end portion corresponding to ⅓ of the radially outer end portion in the width direction) of the left-side region of the left-side lattice frame 72L.

The bottom sweeping blade 76 provided at the radially outer end portion of the right-side lattice frame 72R (this bottom sweeping blade is hereinafter referred to as a right-frame bottom sweeping blade 76RF) is formed substantially in a rectangular shape that extends in the width direction, and is provided at the radially outer end portion (i.e., on the entire surface in the width direction of the radially outer end portion) of the central region and the right-side region of the right-side lattice frame 72R. The right-frame bottom sweeping blade 76RF is provided in an overlapping manner between the left-side radial conveying blade 75L and the right-side radial conveying blade 75R in the rotational direction of the rotational shaft 71.

An opening 77 substantially having a rectangular shape that is long in the width direction is opened in a portion of the right-frame bottom sweeping blade 76RF at the left side in the width direction.

The bottom sweeping blade 76 provided at the radially outer end portion of the left-side radial conveying blade 75L (this bottom sweeping blade is hereinafter referred to as a left-side bottom sweeping blade 76L) is formed substantially in a rectangular shape that extends in the width direction, and is provided on the entire surface in the width direction of the radially outer end portion of the left-side radial conveying blade 75L.

The bottom sweeping blade 76 provided at the radially outer end portion of the right-side radial conveying blade 75R (this bottom sweeping blade is hereinafter referred to as a right-side bottom sweeping blade 76R) is formed substantially in a rectangular shape that extends in the width direction, and is provided on the entire surface in the width direction of the radially outer end portion of the right-side radial conveying blade 75R.

The bottom sweeping blades 76 have a length that allows sliding contact with the inner surface of the bottom wall 63. In the rotational direction of the rotational shaft 71, the proximal end portions of the bottom sweeping blades 76 fixed to the radially outer end portions are on the upstream side, and the free end portions of the bottom sweeping blades 76 separated from the radially outer end portions are on the downstream side.

As shown in FIG. 3, the opening 77 of the right-frame bottom sweeping blade 76RF is disposed in an opposing relationship to the cartridge-side return port 66 in the front-back direction. That is, the opening 77 is disposed so as to include the projection range of the cartridge-side return port 66 projected in the front-back direction.

(3) Operation of Developing Cartridge

During formation of an image, the agitator 39 and the auger 36 are rotated by the driving force of a motor provided within the body casing 2.

When the agitator 39 rotates, as shown in FIGS. 3 and 4, developer stored within the developer cartridge 32 at the central portion in the width direction is flown in the axial direction of the rotational shaft 71 by the first axial conveying blades 73 and the second axial conveying blades 74 and is conveyed to both end portions in the width direction.

Specifically, for example, as shown in FIG. 3, when the first axial conveying blades 73 and the second axial conveying blades 74 are inclined along the line connecting the upper right corner and the lower left corner in FIG. 3, the developer in contact with the blades is conveyed from the central portion in the width direction to the left end portion (the X1 direction in FIG. 3) in accordance with the inclination of the first axial conveying blades 73. In contrast, for example, as shown in FIG. 4, when the first axial conveying blades 73 and the second axial conveying blades 74 are inclined along the line connecting the upper left corner and the lower right corner in FIG. 4, the developer in contact with the blades is conveyed from the central portion in the width direction to the right end portion (the X2 direction in FIG. 4) in accordance with the inclination of the second axial conveying blades 74. That is, the developer at the central portion in the width direction can be pushed aside toward the left or right end portion from in the width direction by the rotation of the first axial conveying blades 73 and the second axial conveying blades 74.

The developer conveyed to the left end portion is conveyed in the radial direction of the rotational shaft 71 by the left-side radial conveying blade 75L coming from the back side and is flown to the left-side cartridge-side supply port 67 opposite the left-side radial conveying blade 75L, and is finally supplied to the left end portion within the housing portion 51 via the left-side cartridge-side supply port 67 and the left-side frame-side supply port 58.

The developer conveyed to the right end portion is conveyed in the radial direction of the rotational shaft 71 by the right-side radial conveying blade 75R coming from the back side and is flown to the right-side cartridge-side supply port 67 opposite the right-side radial conveying blade 75R, and is finally supplied to the right end portion within the housing portion 51 via the right-side cartridge-side supply port 67 and the right-side frame-side supply port 58.

When the agitator 39 rotates, the developer accumulated on the inner surface of the bottom wall 63 is swept away by the rotation of the bottom sweeping blade 76 and is conveyed in respective directions by the axially leftward conveying blade 73, the axially rightward conveying blade 74, and the radial conveying blade 75.

The bottom sweeping blade 76 conveys the developer accumulated on the inner surface of the bottom wall 63 in the radial direction of the rotational shaft 71 while sweeping away the developer. For this reason, at both end portions, the developer is conveyed to the respective cartridge-side supply ports 67 by the axially leftward conveying blade 75L and the axially rightward conveying blade 75R and is also conveyed to the respective cartridge-side supply ports 67 by the respective bottom sweeping blades 76. Accordingly, the developer is flown to the respective cartridge-side supply ports 67 by a strong pressing force and is supplied to both end portions within the housing portion 51 via the respective cartridge-side supply ports 67 and the respective frame-side supply ports 58.

The developer supplied to the left end portion within the housing portion 51 is supplied to the supply roller 34 while being conveyed to the central portion of the housing portion 51 in the width direction by the rightward conveying screw 41 of the rotating auger 36. In contrast, the developer supplied to the right end portion within the housing portion 51 is supplied to the supply roller 34 while being conveyed to the central portion of the housing portion 51 in the width direction by the leftward conveying screw 42 of the rotating auger 36.

The developer conveyed to the central portion of the housing portion 51 in the width direction, which has not been supplied to the supply roller 34, is supplied to the central portion within the developer cartridge 32 in the width direction via the frame-side return port 57 and the cartridge-side return port 66.

The developer supplied to the central portion within the developer cartridge 32 in the width direction is conveyed toward the left end portion in the width direction when the developer is brought into contact with the first axial conveying blades 73, as shown in FIG. 3, and is conveyed toward the right end portion in the width direction when the developer is brought into contact with the second axial conveying blades 74, as shown in FIG. 4. That is, the developer is conveyed to the left end portion or the right end portion in an alternating manner.

That is, the developer is first conveyed from the central portion of the developer cartridge 32 in the width direction toward the both end portions in the width direction by the first axial conveying blades 73 and the second axial conveying blades 74. Thereafter, the developer is conveyed from the inside of the developer cartridge 32 to the inside of the housing portion 51 by the radial conveying blade 75 and the bottom sweeping blade 76 and then, by the auger 36, from the both end portions in the width direction of the housing portion 51 to the central portion in the width direction, and is again conveyed from the housing portion 51 to the central portion of the developer cartridge 32 in the width direction. Accordingly, it is possible to secure circulation of the developer between the developer cartridge 32 and the housing portion 51.

According to the above-described developing cartridge 28, the developer stored in the developer cartridge 32 is conveyed by the agitator 39 to the inside of the housing portion 51 from the cartridge-side supply ports 67 and the frame-side supply ports 58 at both end portions in the width direction. For this reason, it is possible to prevent the developer from being left accumulated at both end portions in the width direction within the housing portion 51. The developer stored in the housing portion 51 is returned to the inside of the developer cartridge 32 from the frame-side return port 57 and the cartridge-side return port 66 at both end portions in the width direction. For this reason, it is possible to secure circulation of the developer between the housing portion 51 and the developer cartridge 32. As a result, it is possible to prevent deterioration of the developer and to thus maintain good image quality.

The reason the developer is prevented from being left accumulated at both end portions in the width direction of the housing portion 51 when the developer is conveyed to the inside of the housing portion 51 via the cartridge-side supply ports 67 and the frame-side supply ports 58 at both ends in the width direction is based on the following facts.

That is, a structure can be considered in which the developer at the central portion in the width direction is conveyed to the inside of the housing portion 51 from the inside of the developer cartridge 32 and in which the developer at both end portions in the width direction is conveyed to the inside of the developer cartridge 32 from the inside of the housing portion 51. In such a structure, a portion of the developer conveyed to the inside of the housing portion 51 from the inside of the developer cartridge 32 is flown toward the supply roller 35, and the other portion of the developer is moved from the central portion to the both end portions and thus flown into the developer cartridge 32. In such a case, at both end portions, the amount of flow of the developer flowing from the housing portion 51 to the developer cartridge 32 is decreased by the amount of flow of the developer flown toward the supply roller 35. For this reason, the developer is likely to be left at the both end portions in the width direction within the housing portion 51.

To the contrary, in a structure in which the developer at the both end portions in the width direction is conveyed from the inside of the developer cartridge 32 to the inside of the housing portion 51, and in which the developer at the central portion in the width direction is conveyed from the inside of the housing portion 51 to the developer cartridge 32, the developer at the both end portions flowing from the developer cartridge 32 to the housing portion 51 is not leaked anywhere so the amount of flow thereof is maintained. For this reason, the developer is not likely to be left accumulated at both end portions in the width direction within the housing portion 51.

There are additional reasons. Generally, the auger provided in the housing portion 51 is smaller in diameter than the diameter of the agitator provided to the developer cartridge 32 and thus the auger provided in the housing portion 51 provides a smaller conveying force than the agitator. That is, because the developer at the both end portions in the width direction is conveyed by such an agitator 39 from the developer cartridge 32 to the housing portion 51, the developer is not likely to be left accumulated at the both end portions in the width direction within the housing portion 51.

In the agitator 39, the first axial conveying blades 73 and the second axial conveying blades 74 convey the developer from the central portion in the width direction to the both end portions in the width direction. For this reason, it is possible to convey the developer stored in the developer cartridge 32 to the inside of the housing portion 51 via the cartridge-side supply ports 67 and the frame-side supply ports 58 in a secure manner.

The first axial conveying blades 73 and the second axial conveying blades 74 are disposed so as to be inclined with respect to the axial direction of the rotational shaft 71. For this reason, it is possible to convey the developer in the axial direction in a secure manner. If the first axial conveying blade 73 and the second axial conveying blade 74 are provided around the rotational shaft 71 with the central angle within a range of 360 degrees (in other words, the first axial conveying blades 73 and the second axial conveying blades 74 are provided covering 360 degrees around the axis of the rotational shaft, i.e., on both sides thereof), when the first axial conveying blades 73 and the second axial conveying blades 74 rotate once around the rotational shaft 71, the same amounts of the developer are conveyed in two directions, i.e., leftward and rightward in the axial direction, so the developer is not conveyed in any direction. However, in this illustrative aspect, the second axial conveying blades 73 and the second axial conveying blades 74 are provided around the rotational shaft 71 with the central angle within a range of about 180 degrees. Thus, the first axial conveying blades 73 and the second axial conveying blades 74 can convey the developer leftward or rightward in an alternating manner with a phase corresponding to half the one rotation (one cycle).

The first axial conveying blades 73 and the second axial conveying blades 74 are provided at both sides of a straight line in a projection plane of the blades projected in the axial direction of the rotational shaft 71, the straight line passing the rotational shaft 71 in a radial direction along the lattice frame 72. That is, the respective blades 73 and 74 are provided on the one-side surface and the other-side surface of the lattice frame 72, respectively. For this reason, the developer returning to the inside of the developer cartridge 32 via the frame-side return port 57 and the cartridge-side return port 66 is conveyed by the first axial conveying blades 73 and the second axial conveying blades 74 toward the left end portion in the width direction when the developer is brought into contact with the second axial conveying blades 73, and toward the right end portion in the width direction when the developer is brought into contact with the second axial conveying blades 74. As a result, the developer can be conveyed toward the left-side cartridge-side supply port 67 and the right-side cartridge-side supply port 67, respectively. That is, the developer returning from the housing portion can be conveyed leftward or rightward in an alternating manner. Accordingly, the flow of the developer is not divided in a concentrating manner onto the left-half side and the right-half side in the axial direction, and it is thus possible to provide a smooth flow the developer.

The first axial conveying blades 73 and the second axial conveying blades 74 are disposed at the left and right sides of the rotational shaft 71 in the axial direction and do not overlap with each other in the axial direction. For this reason, the developer returning to the inside of the developer cartridge 32 via the frame-side return port 57 and the cartridge-side return port 66 can be conveyed toward the left-side cartridge-side supply port 67 and the right-side cartridge-side supply port 67, respectively, by the first axial conveying blades 73 and the second axial conveying blades 74 that are selectively operated with a phase partitioned during the one rotation (one cycle) of the rotational shaft 71.

The first axial conveying blades 73 and the second axial conveying blades 74 are coincidentally disposed within the projection range of the cartridge-side return port 66 projected in the front-back direction. For this reason, it is possible to receive the developer returning to the inside of the developer cartridge 32 via the frame-side return port 57 and the cartridge-side return port 66 at both the first axial conveying blades 73 and the second axial conveying blades 74 and to convey the developer to the left-side cartridge-side supply port 67 and the right-side cartridge-side supply port 67 by means of the respective blades in a secure manner.

The developer at both end portions in the width direction is conveyed by the radial conveying blade 75 in the radial direction of the rotational shaft 71. For this reason, it is possible to convey the developer to the respective cartridge-side supply ports 67 in a secure manner. In addition, the developer is conveyed by the radial conveying blade 75 in a pressed manner to the inside of the housing portion 51 via the cartridge-side supply ports 67 and the right-side frame-side supply port 58. For this reason, with such conveyance, it is possible to prevent the developer from being left accumulated at both end portions in the width direction within the housing portion 51 in a secure manner.

The radial conveying blade 75 is provided in parallel to the rotational shaft 71. For this reason, it is possible to convey the developer in the radial direction of the rotational shaft 71 in a secure manner.

The left-side radial conveying blade 75L and the right-side radial conveying blade 75R are provided so as to extend outward from the rotational shaft 71 in the radial direction. Moreover, the left-side radial conveying blade 75L and the right-side radial conveying blade 75R are provided at both sides of a line perpendicular to a straight line in a projection plane of the blades projected in the axial direction of the rotational shaft 71, the straight line passing the rotational shaft 71 in the radial direction along the radial conveying blade 75. For this reason, the left-side radial conveying blade 75L and the right-side radial conveying blade 75R can convey the developer in the radial direction of the rotational shaft 71 in an alternating manner. In the above-described developer cartridge 32, by delaying the time of the left-side radial conveying blade 75L and the right-side radial conveying blade 75R conveying the developer in the radial direction of the rotational shaft 71, it is possible to prevent the developer returning from the housing portion 51 to the developer cartridge 32 after being conveyed from the developer cartridge 32 to the housing portion 51 from colliding with each other at the central portion in the width direction and thus breaking the circulation of the developer.

The first axial conveying blades 73, the second axial conveying blades 74, and the radial conveying blade 75, which are provided on the lattice frame 72, are provided at different positions in the circumferential direction (the rotational direction) of the rotational shaft 71. For this reason, with the rotation of the rotational shaft 71, the developer is first conveyed by the first axial conveying blades 73 and the second axial conveying blades 74 from the central portion in the width direction toward the both end portions in the width direction. Subsequently, the developer at the both end portions in the width direction is conveyed by the radial conveying blade 75 in the radial direction of the rotational shaft 71. As a result, it is possible to secure efficient circulation of the developer between the housing portion 51 and the developer cartridge 32. That is, since the developer is conveyed in an alternating manner with a delay, it is possible to prevent the developer conveyed from the both ends within the housing portion 51 from colliding with each other and to thus provide a smooth flow of the developer.

The developer accumulated on the inner surface of the bottom wall 63 can be agitated by the bottom sweeping blade 76. For this reason, it is possible to prevent the developer from being left accumulated within the developer cartridge 32.

The right-frame bottom sweeping blade 76RF is provided in an overlapping manner between the left-side radial conveying blade 75L and the right-side radial conveying blade 75R in the rotational direction of the rotational shaft 71. For this reason, at the central portion in the width direction, the developer accumulated on the inner surface of the bottom wall 63 is swept away by the right-frame bottom sweeping blade 76RF, and the developer is conveyed by the first axial conveying blades 73 and the second axial conveying blades 74 from the central portion in the width direction to the both end portions in the width direction. Thereafter, the developer is conveyed by the radial conveying blade 75 in the radial direction of the rotational shaft 71. As a result, it is possible to secure efficient circulation of the developer within the developer cartridge 32.

The opening 77 of the right-frame bottom sweeping blade 76RF is disposed so as to include the projection range of the cartridge-side return port 66 projected in the front-back direction. For this reason, it is possible to cause the developer returning to the inside of the developer cartridge 32 via the frame-side return port 57 and the cartridge-side return port 66 to pass through the opening 77. Accordingly, it is possible to prevent the right-frame bottom sweeping blade 76RF from blocking the developer from returning to the inside of the developer cartridge 32 via the frame-side return port 57 and the cartridge-side return port 66.

The developer conveyed to the inside of the housing portion 51 via the cartridge-side supply ports 67 and the frame-side supply ports 58 is conveyed by the auger 36 from the both end portions in the width direction to the central portion in the width direction. For this reason, it is possible to secure efficient flow of the developer within the housing portion 51. As a result, it is possible to secure good circulation of the developer between the developer cartridge 32 and the housing portion 51.

(Additional Illustrative Aspects)

In the above-described illustrative aspects, the developing frame 31 is attached to or detached from the process frame 24. However, the process frame 24 and the developing frame 31 may be integrated with each other. In this case, the developer cartridge 32 is attached to or detached from the process frame 24.

Further, although illustrative aspects of the present inventive concept have been described in relation to a laser printer, the present inventive concept is not limited to a monochrome laser printer. Rather, the present inventive concept can also be applied to a color laser printer, including a tandem type and an intermediate transfer type printer.

Still further, in the above-described illustrative aspects, the auger 36 is provided in the housing portion 51. However, in some cases, adequate circulation of the developer may be provided by the agitator 39. Thus, in such cases, the auger 36 may be omitted.

Still further, in the above-described illustrative aspects, the inner first axial conveying blade 73In and the outer first axial conveying blade 73Out are disposed at the same intersection angle with respect to the rotational shaft 71, and the inner second axial conveying blade 74In and the outer second axial conveying blade 74Out are also disposed at the same intersection angle with respect to the rotational shaft 71. However, the present inventive concept is not limited to this. Thus, for example, the inner first axial conveying blade 73In and the outer first axial conveying blade 73Out may be disposed at different intersection angles with respect to the rotational shaft 71, and the inner second axial conveying blade 74In and the outer second axial conveying blade 74Out may be disposed at different intersection angles with respect to the rotational shaft 71.

Still further, in the above-described illustrative aspects, although the radial conveying blade 75 is provided, in some cases, it is possible for the bottom sweeping blade 76 to adequately convey the developer accumulated on the inner surface of the bottom wall 63 in the radial direction of the rotational shaft 71 while sweeping away the developer. For this reason, the bottom sweeping blade 76 may also correspond to the second blade of the present invention, and in such cases, the radial conveying blade 75 may be omitted, and bottom sweeping blade 76 may be used in place of the combination of the radial conveying blade 75 and the bottom sweeping blade 76.

While the present inventive concept has been shown and described with reference to certain illustrative aspects thereof, it will be understood by those skilled in the art that various changes in form and details may be made therein without departing from the spirit and scope of the invention as defined by the appended claims.

What is claimed is:

1. A developing device comprising:

a first housing that receives a developing roller;

a second housing that is attachable to and detachable from the first housing and stores developer;

a first communication path that is provided opposite the developing roller at a midpoint between both end portions in an axial direction of the developing roller and that allows an inside of the first housing to communicate with an inside of the second housing;

a second communication path that is provided opposite the developing roller at both end portions in the axial direction of the developing roller and that allows the inside of the first housing to communicate with the inside of the second housing; and an agitator that is provided within the second housing and conveys the developer from the first communication path toward the second communication path, wherein the agitator comprises:

a rotational shaft disposed such that an axial direction of the rotational shaft is substantially parallel to the axial direction of the developing roller; and a first blade that is provided at a midpoint between both end portions in the axial direction of the rotational shaft and conveys the developer from the midpoint in the axial direction of the rotational shaft to both end portions in the axial direction of the rotational shaft, and wherein the first blade is provided around the rotational shaft so as to intersect the axial direction of the rotational shaft.

2. The developing device according to claim 1, wherein the first blade comprises a plurality of first blades, the plurality of first blades provided on a first side and a second side of a projection plane which includes a rotational axis of the agitator.

3. The developing device according to claim 2, wherein at least a portion of each of the blades on the first side and at least a portion of each of the blades on the second side are disposed to coincide with a projection range of the first communication path.

4. The developing device according to claim 1, wherein the agitator comprises:

a second blade that is provided opposite the second communication path at both end portions in the axial direction of the rotational shaft and conveys the developer in the radial direction with respect to the rotational shaft.

5. The developing device according to claim 4, wherein the second blade is provided in parallel to the rotational shaft.

6. The developing device according to claim 4, wherein the second blade comprises a plurality of second blades, the plurality of second blades provided on both sides of a projection plane which includes a rotational axis of the agitator.

7. The developing device according to claim 1, wherein the first housing comprises a conveying member which conveys the developer from both end portions in the axial direction of the developing roller to the midpoint of the developing roller.

8. A developing device comprising:

a first housing that receives a developing roller;

a second housing that is attachable to and detachable from the first housing and stores developer;

a first communication path that is provided opposite the developing roller at a mid point between both end portions in an axial direction of the developing roller and that allows an inside of the first housing to communicate with an inside of the second housing;

a second communication path that is provided opposite the developing roller at both end portions in the axial direction of the developing roller and that allows the inside of the first housing to communicate with the inside of the second housing; and an agitator that is provided within the second housing and conveys the developer from the first communication path toward the second communication path, wherein the agitator comprises:

a rotational shaft disposed such that an axial direction of the rotational shaft is substantially to the axial direction of the developing roller;

a first blade that is provided at a midpoint between both end portions in the axial direction of the rotational shaft and conveys the developer from the midpoint in the axial direction of the rotational shaft to both end portions in the axial direction of the rotational shaft, a second blade that is provided opposite the second communication a h at both end portions in the axial direction of the rotational shaft and conveys the developer in the radial direction with respect to the rotational shaft, and wherein the first blade comprises a plurality of first blades and the second blade comprises a plurality of second blades, and the plurality of first blades and the plurality of second blades are disposed at different positions in a rotational direction of the rotational shaft.

9. A developing device comprising;

a first housing that receives a developing roller;

a second housing that is attachable to and detachable from the first housing and stores developer;

a first communication path that is provided opposite the developing roller at a midpoint between both end portions in an axial direction of the developing roller and that allows an inside of the first housing to communicate with an inside of the second housing a second communication path that is provided opposite the developing roller at both end portions in the axial direction of the developing roller and that allows the inside of the first housing to communicate with the inside of the second housing; and an agitator that is provided within the second housing and conveys the developer from the first communication path toward the second communication path, wherein the agitator comprises:

a rotational shaft disposed such that an axial direction of the rotational shaft is substantially parallel to the axial direction of the developing roller;

a first blade that is provided at a midpoint between both end portions in the axial direction of the rotational shaft and conveys the developer from the midpoint in the axial direction of the rotational shaft to both end portions in the axial direction of the rotational shaft, a second blade that is provided opposite the second communication path at both end portions in the axial direction of the rotational shaft and conveys the developer in the radial direction with respect to the rotational shaft, and a third blade that is supported by the rotational shaft and is in sliding contact with an inner bottom surface of the second housing.

10. The developing device according to claim 9, wherein the third blade is provided at least between the second blades in the axial direction of the rotational shaft.

11. The developing device according to claim 9, wherein the third blade is formed with an opening coinciding with a projection range of the first communication path.

12. A developer cartridge comprising:

a housing that stores developer; and an agitator that is provided within the housing and agitates the developer, the agitator comprising:

a rotational shaft that is disposed in one direction;

a first blade that is provided at a midpoint between both end portions in the axial direction of the rotational shaft and conveys the developer from the midpoint in the axial direction of the rotational shaft to both end portions of the rotational shaft;

a second blade that is provided at both end portions in the axial direction of the rotational shaft and conveys the developer in a radial direction with respect to the rotational shaft; and a third blade that extends from the rotational shaft and is in sliding contact with an inner bottom surface of the housing.

13. The developer cartridge according to claim 12, wherein the first blade is provided around the rotational shaft so as to intersect the axial direction of the rotational shaft.

14. The developer cartridge according to claim 13, wherein the first blade comprises a plurality of first blades, the plurality of first blades provided on a first side and a second side of a projection plane which includes a rotational axis of the agitator.

15. The developer cartridge according to claim 12, wherein the second blade is provided in parallel to the rotational shaft.

16. The developer cartridge according to claim 12, wherein the second blade comprises a plurality of second blades, the plurality of second blades provided on both sides of a projection plane which includes a rotational axis of the agitator.

17. The developer cartridge according to claim 12, wherein the first blade comprises a plurality of first blades and the second blade comprises a plurality of second blades, and the plurality of first blades and the plurality of second blades are disposed at different positions in a rotational direction of the rotational shaft.

18. The developer cartridge according to claim 12, wherein the third blade is provided at least between the second blades in the axial direction of the rotational shaft.

19. The developer cartridge according to claim 12, wherein the third blade comprises an opening.

* * * * *

UNITED STATES PATENT AND TRADEMARK OFFICE

CERTIFICATE OF CORRECTION

PATENT NO. : 8,036,579 B2
APPLICATION NO. : 12/057596
DATED : October 11, 2011
INVENTOR(S) : Hideshi Nishiyama et al.

It is certified that error appears in the above-identified patent and that said Letters Patent is hereby corrected as shown below:

In Column 19, Claim 8, Line 47:
Replace "substantially to" with --substantially parallel to--

In Column 19, Claim 8, Line 55:
Replace "communication a h at" with --communication path at--

Signed and Sealed this
Twenty-fourth Day of April, 2012

David J. Kappos

David J. Kappos
*Director of the United States Patent and Trademark Office*